US008308136B2

(12) United States Patent
Sanders

(10) Patent No.: US 8,308,136 B2
(45) Date of Patent: Nov. 13, 2012

(54) TOOL, SYSTEM AND METHOD FOR RAILCAR MAINTENANCE

(75) Inventor: Joe David Sanders, Penhook, VA (US)

(73) Assignee: Norfolk Southern Corporation, Norfolk, VA (US)

( * ) Notice: Subject to any disclaimer, the term of this patent is extended or adjusted under 35 U.S.C. 154(b) by 637 days.

(21) Appl. No.: 12/509,000

(22) Filed: Jul. 24, 2009

(65) Prior Publication Data

US 2011/0017964 A1 Jan. 27, 2011

(51) Int. Cl.
*B66F 3/00* (2006.01)

(52) U.S. Cl. ..... 254/130; 254/134

(58) Field of Classification Search ..... 254/130, 254/131.5, 134, 133 R, 120
See application file for complete search history.

(56) References Cited

U.S. PATENT DOCUMENTS

| | | | | |
|---|---|---|---|---|
| 98,683 | A | 1/1870 | Freeman | |
| 134,151 | A | 12/1872 | Maharg | |
| 737,522 | A | 8/1903 | Sullivan | |
| 742,196 | A | 10/1903 | Jones | |
| 849,923 | A | 4/1907 | Shell | |
| 911,632 | A | 2/1909 | Wie | |
| 1,430,397 | A | 9/1922 | Moore | |
| 1,534,797 | A | 4/1925 | McLeod | |
| 3,700,132 | A | 10/1972 | Waters | |
| 3,734,304 | A | 5/1973 | Cabaniss | |
| 4,096,952 | A | 6/1978 | Diggs | |
| 4,153,305 | A | 5/1979 | Kennedy | |
| 4,491,227 | A | 1/1985 | Buzzichelli | |
| 5,232,192 | A | 8/1993 | Akutagawa | |
| 6,409,151 | B1 * | 6/2002 | Cormier | 254/8 R |
| 7,093,669 | B2 * | 8/2006 | Walsh | 173/90 |
| 7,293,759 | B2 * | 11/2007 | Beach et al. | 254/131 |
| 2002/0043137 | A1 | 4/2002 | Yeo | |
| 2006/0043041 | A1 | 3/2006 | Lopes | |
| 2010/0213425 | A1 * | 8/2010 | Davis | 254/131 |
| 2011/0017964 | A1 * | 1/2011 | Sanders | 254/130 |

FOREIGN PATENT DOCUMENTS

| | | |
|---|---|---|
| WO | WO 9721622 | 6/1997 |

OTHER PUBLICATIONS

PCT International Search Report (Sep. 3, 2010).
PCT Written Opinion of the International Searching Authority (Sep. 3, 2010).

* cited by examiner

*Primary Examiner* — Lee D Wilson
(74) *Attorney, Agent, or Firm* — Goodwin Procter LLP

(57) ABSTRACT

Embodiments of a mechanical tool for railcar maintenance are disclosed, which are most suitable for handling heavy components during undercarriage operations. In one particular embodiment, the tool may include: a cantilever beam having a first end and a second end with a support element disposed between these two ends for pivotally attaching the cantilever beam to a supporting device; a first attachment element configured to grip a first railcar component; a safety latch mechanism, at the first end, for securing the first attachment element, including when the first railcar component is gripped by the first attachment element, and for preventing disengagement of the first attachment element unless the cantilever beam is in a substantially level position; and a weight element adjustably disposed between the support element and the second end as a counterbalance.

13 Claims, 11 Drawing Sheets

TOOL, SYSTEM AND METHOD FOR RAILCAR MAINTENANCE

FIELD OF THE INVENTION

The present invention relates generally to mechanical tools. More particularly, the present invention relates to a tool, system and method for railcar maintenance, including especially undercarriage operations.

BACKGROUND OF THE INVENTION

In the railway industry, railcars require routine inspection and maintenance in order to keep them in safe working conditions. As used herein, the term "railcar" refers to any of a variety of railroad vehicles including but not limited to locomotives, tender vehicles, and railroad cars, which may be used for freight, passenger, and/or switching applications. Each railcar typically includes a number of undercarriage components or equipment, such as wheels, traction motors, air brakes, compressed air units, and traction sanding devices, which are located in an undercarriage assembly below the railcar platform. Since these undercarriage components are crucial to the safe and efficient operation of the railcar, most, if not all, of them have to be routinely inspected and some need to be replaced or serviced on a regular basis. For example, air brake valves and/or portions thereof are swapped out for services and then re-installed according to a maintenance schedule. Typically, most of the railcar maintenance work is performed manually by skilled mechanics.

Unfortunately, many of the undercarriage components are quite heavy and/or tugged away in hard-to-reach locations, making it difficult to remove or re-install those components. With conventional tools and methods, it often requires significant efforts of multiple workers to remove or re-install each piece of undercarriage components. When a component is being positioned or extracted, one or more of the maintenance workers may have to operate in an awkward position and expend a significant amount of energy to maneuver the heavy component into its designated location. During the process, accidents could easily occur, injuring the worker(s) and/or damaging the component.

In view of the foregoing, it may be understood that there are significant problems and shortcomings associated with current tools and methods for railcar maintenance.

SUMMARY OF THE INVENTION

Embodiments of a mechanical tool for railcar maintenance are disclosed, which are most suitable for handling heavy components during undercarriage operations. In one particular embodiment, the tool may include: a cantilever beam having a first end and a second end; a support element disposed between said first end and said second end for pivotally attaching said cantilever beam to a supporting device; a first attachment element configured to grip a first railcar component; a safety latch mechanism, at said first end, for securing said first attachment element, including when said first railcar component is gripped by said first attachment element, and for preventing disengagement of said first attachment element unless said cantilever beam is in a substantially level position; and a weight element adjustably disposed between said support element and said second end, wherein said weight element, when positioned at a first predetermined stop location marked along said cantilever beam, substantially counterbalances said first railcar component gripped by said first attachment element at said first end.

In another embodiment, a system for assisting undercarriage maintenance to a railcar may include: a supporting device with at least limited mobility; a cantilever beam pivotally attached to and supported by said supporting device, said cantilever beam having a first end and a second end; a plurality of attachment elements, each attachment element being configured to grip a different railcar component; a safety latch mechanism, at said first end of said cantilever beam, for interchangeably securing any of said plurality of attachment elements and for preventing disengagement thereof unless said cantilever beam is, in a substantially level position; and a weight element adjustably disposed toward said second end of said cantilever beam, wherein said weight element, when positioned at each of a plurality of predetermined stop locations marked along said cantilever, substantially counterbalances a corresponding railcar component attached to said first end of said cantilever.

In yet another embodiment, a method of performing undercarriage maintenance to a railcar may include the steps of: pivotally attaching a cantilever beam to a supporting device; identifying a railcar component to be handled; selecting an attachment element adapted to grip said railcar component; securing said attachment element to a first end of said cantilever beam via a safety latch mechanism that prevents disengagement of said attachment element unless said cantilever beam is in a substantially level position; causing said railcar component to be gripped by said attachment element before or after said attachment element is secured to said first end of said cantilever beam; positioning a weight element at a predetermined stop location marked along said cantilever beam such that said weight element substantially counterbalances said railcar component; and moving said railcar component to or from an undercarriage position through movement(s) of said supporting device and/or said cantilever beam.

The present invention will now be described in more detail with reference to exemplary embodiments thereof as shown in the accompanying drawings. While the present invention is described below with reference to exemplary embodiments, it should be understood that the present invention is not limited thereto. Those of ordinary skill in the art having access to the teachings herein will recognize additional implementations, modifications, and embodiments, as well as other fields of use, which are within the scope of the present invention as described herein, and with respect to which the present invention may be of significant utility.

BRIEF DESCRIPTION OF THE DRAWINGS

In order to facilitate a fuller understanding of the present invention, reference is now made to the accompanying drawings, in which like elements are referenced with like numerals. These drawings should not be construed as limiting the present invention, but are intended to be exemplary only.

DETAILED DESCRIPTION OF THE INVENTION

Embodiments of the present invention provide for a tool, system, and method for safer and more efficient maintenance of railcars. With a safety latch mechanism, an adjustable counterweight assembly, and interchangeable attachment elements, the tool can be adapted to securely grip and balance standard and/or non-standard railcar components. The tool can be pivotally attached to a supporting device with at least some mobility, such that a railcar component gripped by the tool can be effortlessly maneuvered to/from or positioned in hard-to-reach undercarriage locations.

Figure 1:
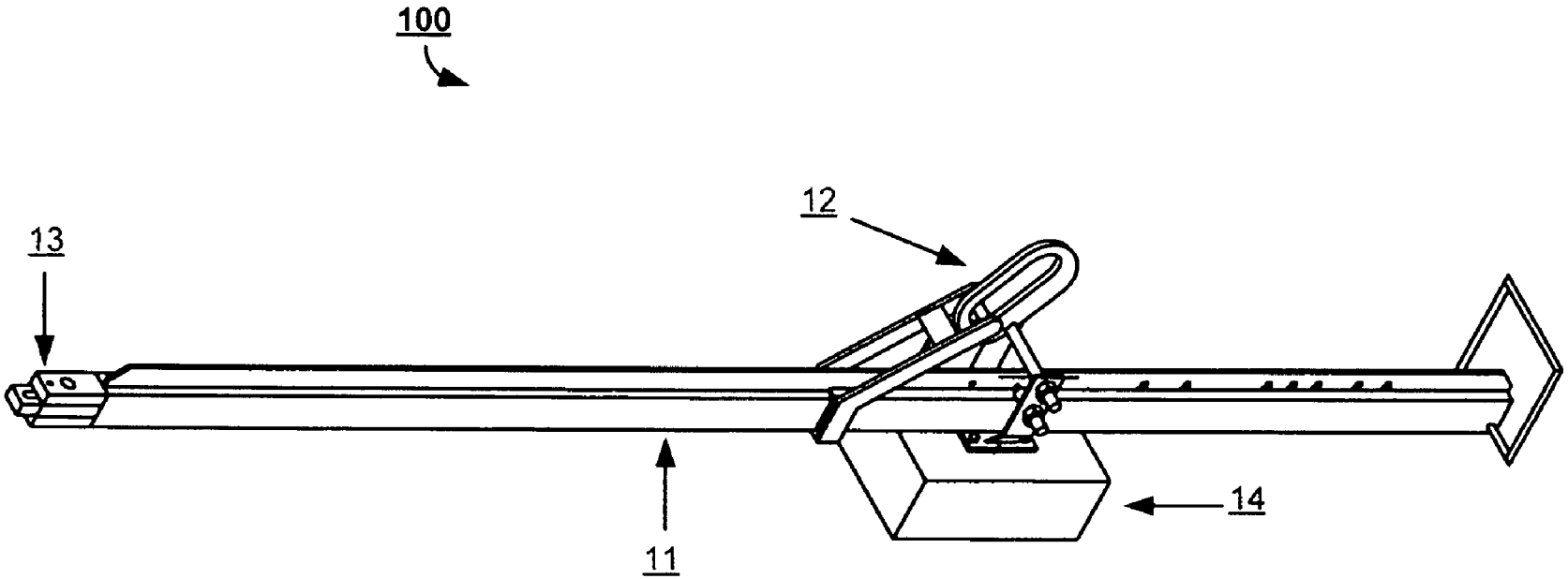
FIG. 1 shows an assembled view of an exemplary tool for railcar maintenance in accordance with an embodiment of the present invention.

Referring to FIG. 1, there is shown an assembled view of an exemplary tool 100 for railcar maintenance in accordance with an embodiment of the present invention. As shown, the tool 100 generally comprises a cantilever beam 11, a support element 12, a safety latch mechanism 13, and a counterweight assembly 14. The support element 12 may allow the cantilever beam 11 to be pivotally supported by or balanced on a supporting device (not shown) such as a crane, a monorail lifting system, a lift truck, a boom truck, a jack or hoist. The safety latch mechanism 13, located at one end of the cantilever beam 11, is designed to work with a number of interchangeable attachment elements (not shown in FIG. 1), wherein each attachment element is adapted to grip a railcar component and be secured to the safety latch mechanism 13. In a locked state, the safety latch mechanism 13 may prevent disengagement of the attachment element secured thereto unless the cantilever beam 11 is in a substantially level position. The counterweight assembly 14 is located towards the other end of the cantilever beam 11 and can be adjusted to various pre-determined or pre-marked stop locations to counterbalance a railcar component gripped at the safety latch end of the cantilever beam 11.

Figure 2:
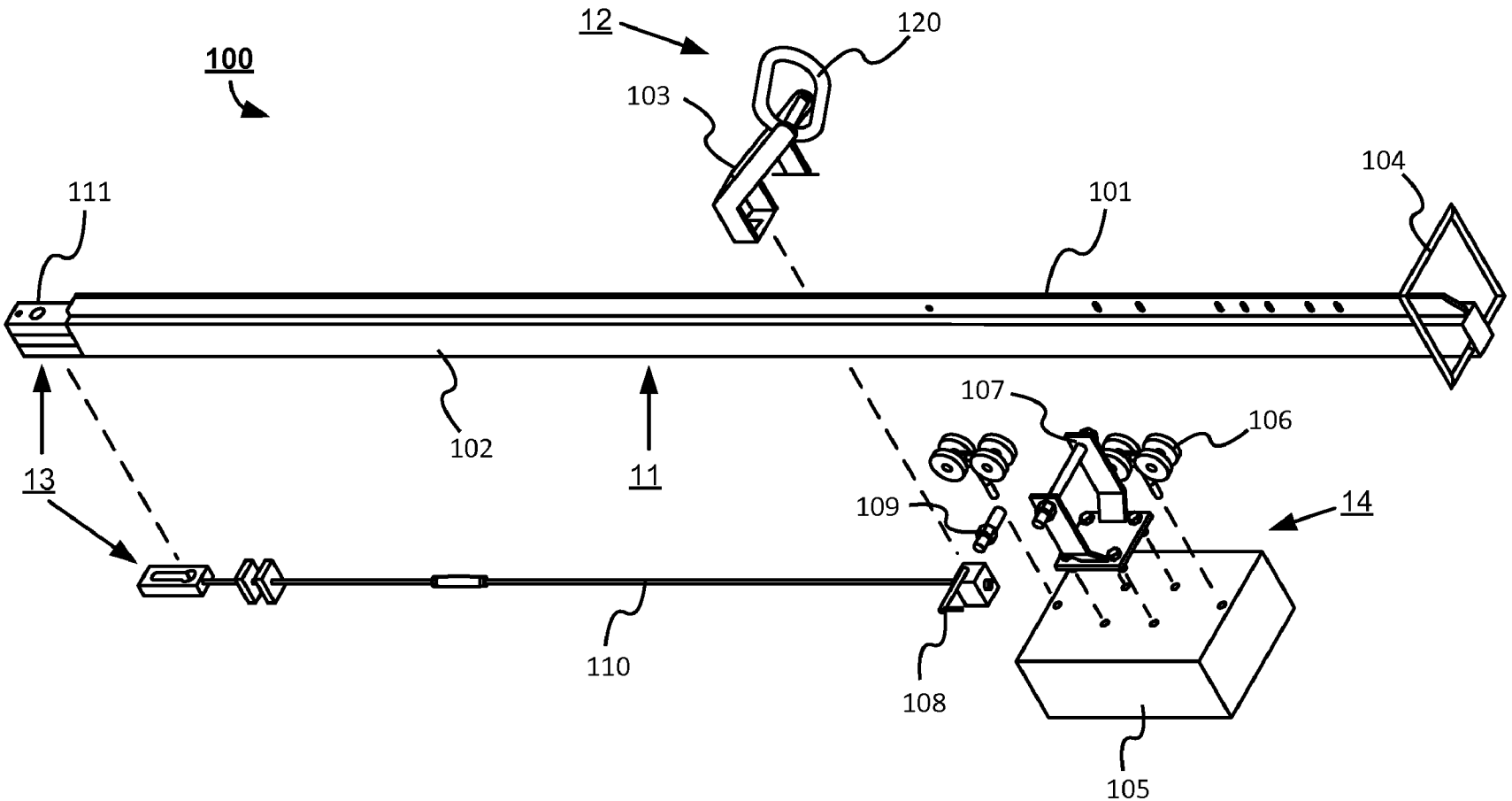
FIG. 2 shows an exploded view of the exemplary tool for railcar maintenance in accordance with an embodiment of the present invention.

FIG. 2 shows an exploded view of the exemplary tool 100 exhibiting more details of the cantilever beam 11, the support element 12, the safety latch mechanism 13, and the counterweight assembly 14.

Figure 3:
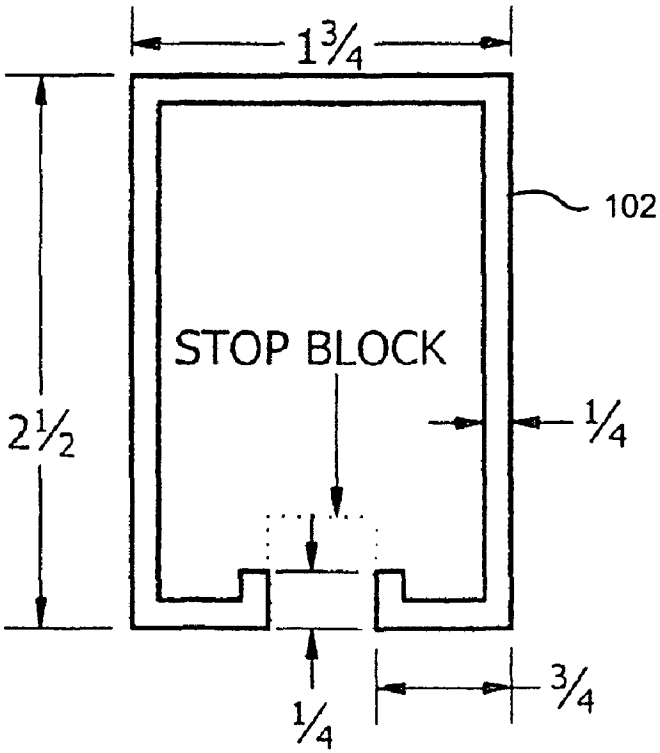
FIG. 3 shows a cross-section of an exemplary cantilever beam main rail in accordance with an embodiment of the present invention.

As shown, the cantilever beam 11 may further comprise a main rail 102, a selector rail 101, and a guide handle 104. The main rail 102 may be a substantially straight metal beam that spans the length of the cantilever beam 11. For at least part of its length, the main rail 102 may be hollow, for example, to save material, reduce weight, increase structural strength, and/or accommodate other parts of the tool 100 as described below. FIG. 3 shows an exemplary cross-section of the main rail 102 in accordance with an embodiment of the present invention. The cross-section is rectangular with a substantially enclosed space surrounded by a quarter-inch-thick metal. On the lower side and at the safety latch end of the main rail 102, a stop block (also illustrated in FIG. 6) may be provided for an activation assembly as will be described in more detail below.

Figure 4:
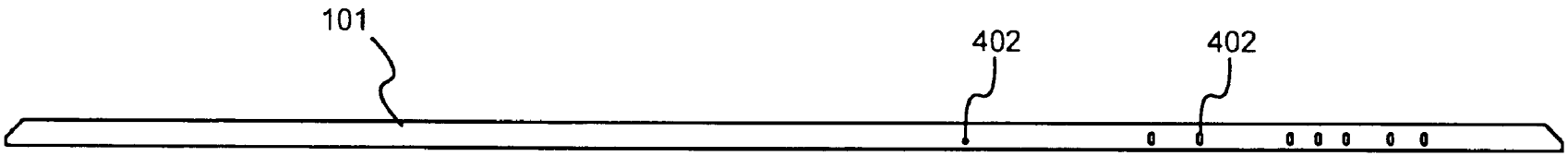
FIG. 4 shows an exemplary design of a selector rail in accordance with an embodiment of the present invention.

As shown in FIG. 2, the selector rail 101 may be a substantially straight metal blade sitting on top of the main rail 102. The selector rail 101 provides a guiding track along which the counterweight assembly 14 may slide. Although shown in FIG. 2 as spanning the full length of the main rail 102, the selector rail 101 is needed only on the counterweight side of the cantilever beam 11. FIG. 4 shows an exemplary design of the selector rail 101 in accordance with an embodiment of the present invention. This exemplary selector rail 101 is approximately 96 inches in length and has one-inch champers at both ends for easy engagement with roller wheels in the counterweight assembly 14 as described below. A number of stop locations 402 are pre-marked on the counterweight side of the selector rail 101. At each stop location 402, there may be a hole drilled through the selector rail 101 to accommodate a selector pin (not shown in FIG. 4) that anchors the counterweight assembly 14 at that stop location.

Referring again to FIG. 2, the guide handle 104 is provided at the counterweight end of the cantilever beam 11. When using or adjusting the tool 100, an operator may hold onto the guide handle 104 to stabilize and/or steer the cantilever beam 11. Although shown here as being affixed to the main rail 102 at a right angle, the guide handle 104 may actually be a detachable element and its angle with respect to the main rail 102 may be adjustable.

Figure 5:
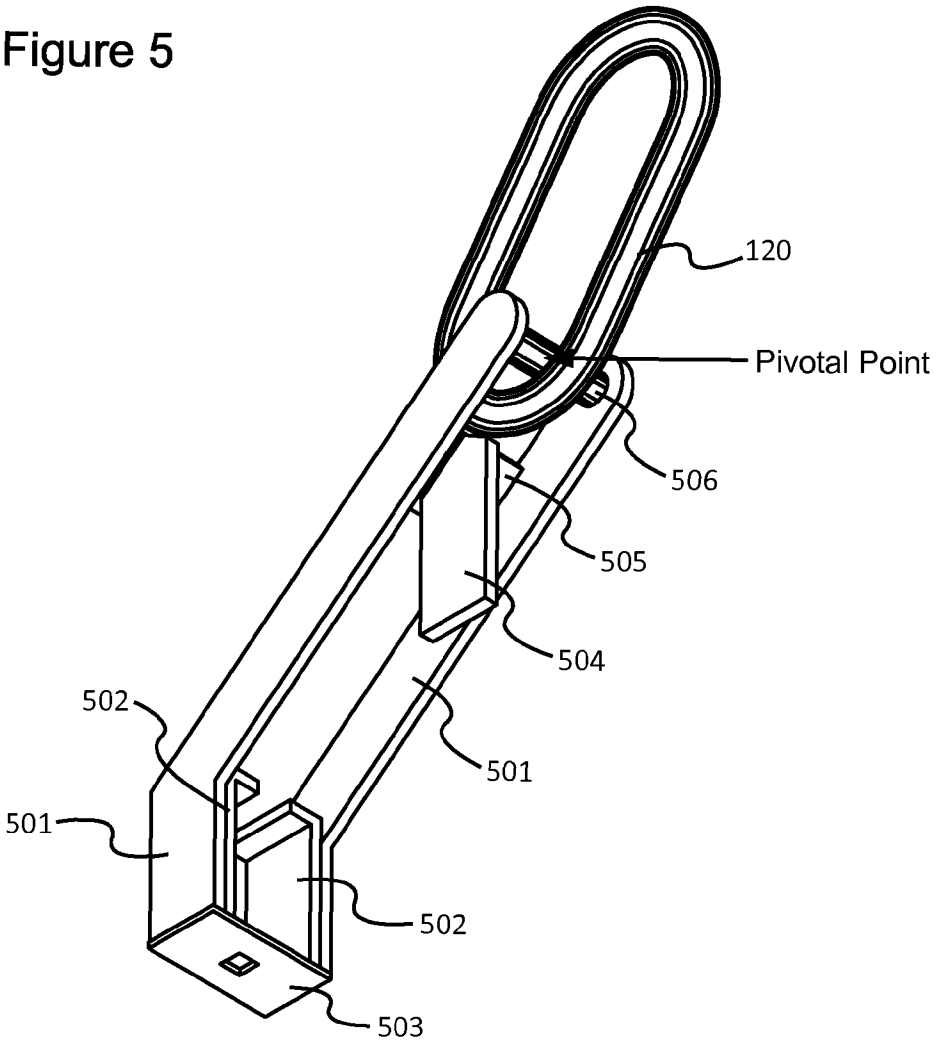
FIG. 5 shows an exemplary design of a support element for a cantilever beam in accordance with an embodiment of the present invention.

The support element 12 serves a function of coupling the cantilever beam 11 to a supporting device (not shown). The support element 12 may thus comprise a lifting assembly 103 and a lift ring 120. FIG. 5 shows an exemplary design of the support element 12 in accordance with an embodiment of the present invention. As shown in FIG. 5, the support element 12 comprises two side lifting braces 501, a main rail lifting brace 502, a bottom lifting support 503, a selector rail support 504, a cross brace 505, and a lifting rod 506. The main rail 102 of the cantilever beam 11 may fit through the main rail lifting brace 502 and be fastened to the bottom lifting support 503. Meanwhile, the top surface of the selector rail 101 may push against and be stabilized by the selector rail support 504. The lifting rod 506 is hooked to the lift ring 120 and provides a pivotal point for the cantilever beam 11.

Figure 6:
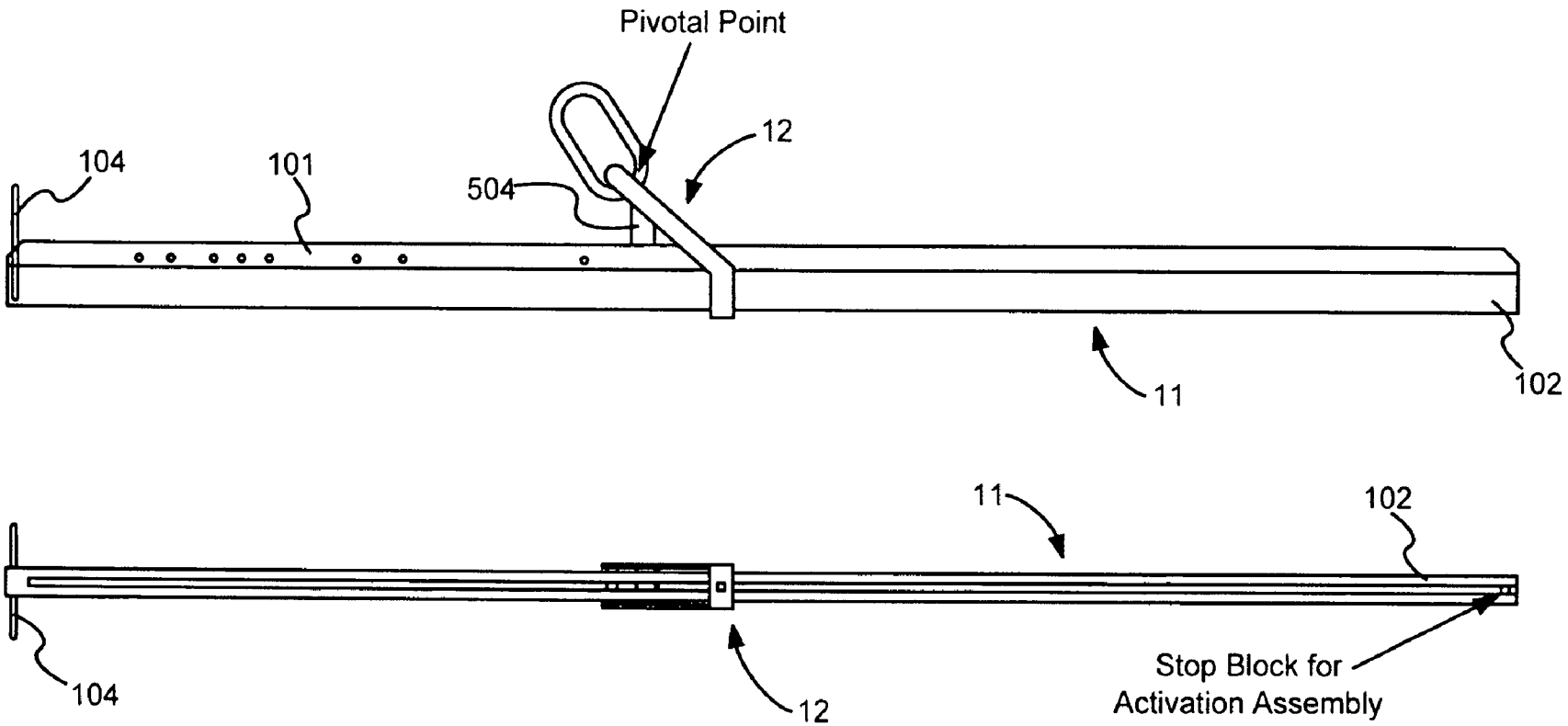
FIG. 6 shows a side view and a bottom plan view of the exemplary cantilever beam and support element in accordance with an embodiment of the present invention.

FIG. 6 shows a side view and a bottom plan view of the exemplary cantilever beam 11 and support element 12 in an assembled state. As shown here, the support element 12 or the pivotal point need not be centered with respect to the cantilever beam 11. In the side view, the selector rail support 504 is seen pushing against and supporting the top surface of the selector rail 101. In the bottom plan view, a stop block (which is also indicated in FIG. 3) can be seen at the safety latch end of the main rail 102. The stop block is provided to work with an activation assembly as described below.

At this point, it should be noted that, although the exemplary support element 12 as illustrated in FIGS. 1, 2, 5, and 6 appears adapted for supporting the cantilever beam 11 on its top side, i.e., through lifting, the support element (and/or the other parts of the tool 100) may also be adapted for pivotally supporting the cantilever beam 11 from its bottom side. So, other than hanging from a lifting device (e.g., a crane or hoist), the cantilever beam 11 may alternatively rest upon or be hinged to a jack or the like that provides support from the bottom side. The jack may preferably include wheels or castors to provide at least some mobility for the tool 100. Similarly, if a lifting device is employed, it is preferably mounted on an overhead monorail or to a boom truck.

Referring back to FIG. 2, the safety latch mechanism 13 comprises one or two attachment braces 111 and an activation assembly 110. Each attachment brace 111 may be a rectangular metal member having a through-hole that is oriented approximately in the vertical direction when the cantilever beam 11 is in a substantially level position. As shown in FIG. 2, two attachment braces 111 are provided, and they may be welded to the end of the main rail 102 and disposed on either side of the activation assembly 110. With two attachment braces 111, their through-holes need to be substantially aligned with one another in the vertical direction.

Figure 7:
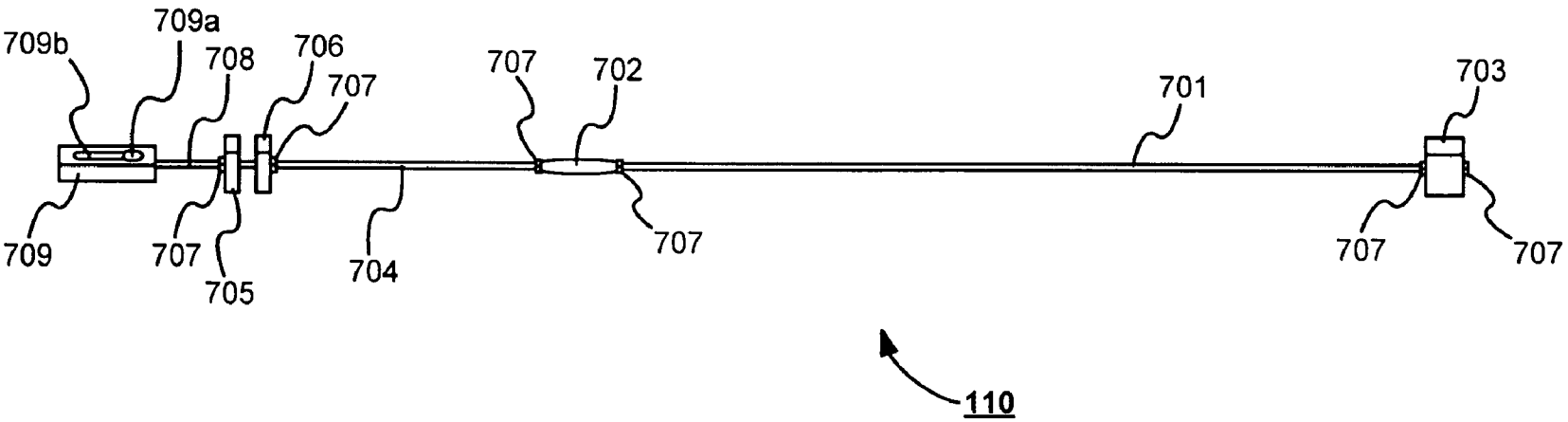
FIG. 7 shows an exemplary design of an activation assembly in accordance with an embodiment of the present invention.

The activation assembly 110, when assembled, fits within the main rail 102 with one end disposed between the two attachment braces 111. FIG. 7 shows an exemplary design of the activation assembly 110 in accordance with an embodiment of the present invention. As shown, the activation assembly 110 comprises a threaded rod assembly coupling an attachment key 709 at one end with a contact block 703 at the other end. The threaded rod assembly may include threaded rods 701, 704, and 708 which are coupled together by a clevis 702, spacers 705, and 706, and hex nuts 707. According to one embodiment of the present invention, the threaded rods 701, 704, and 708 may be made of steel and have a quarter inch diameter. The spacers 705 and 706 may keep the activation assembly 110 substantially centered within the main rail 102. The attachment key 709 may be disposed between the two attachment braces 111 and may have a similar shape and outer dimensions as the two attachment braces 111. The attachment key 709 has a keyway slot vertically therethrough. The keyway slot may include both an opening portion 709*a* and a slot portion 709*b*. The diameter of the opening portion 709*a* may be the same as or similar to that of the through-holes in the attachment braces 111. The width of the slot portion 709*b* is substantially smaller than the diameter of the opening portion 709*a*.

Figure 7B:
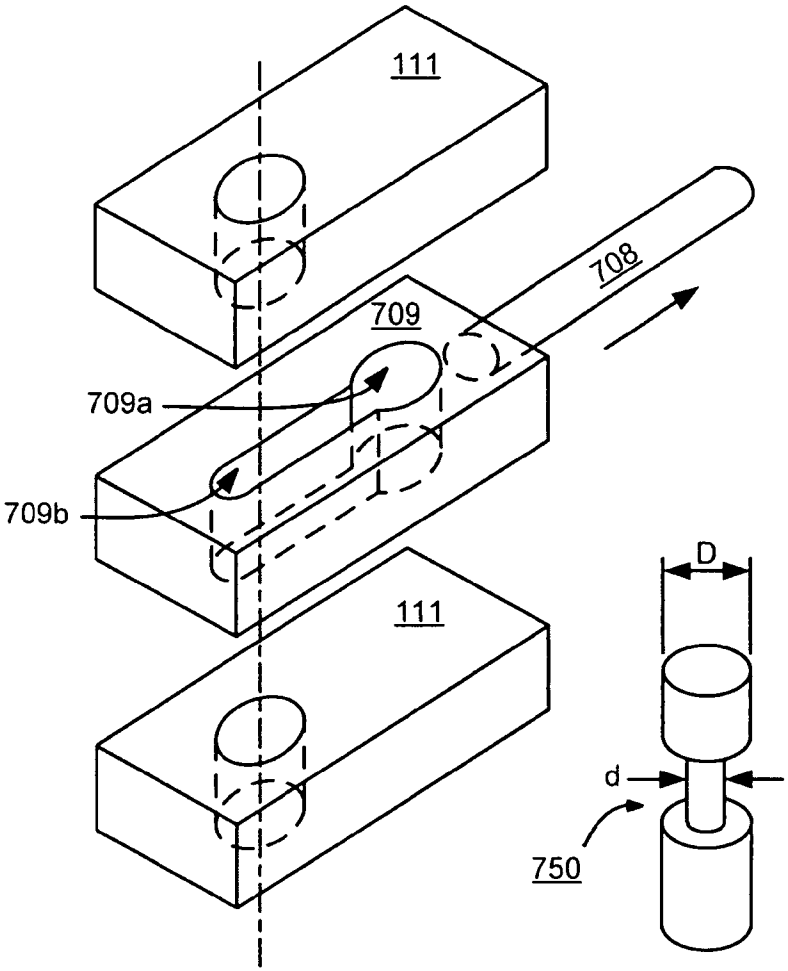
FIGS. 7A and 7B illustrate the operation of an attachment key and attachment braces in a safety latch mechanism in accordance with an embodiment of the present invention.
Figure 7A:
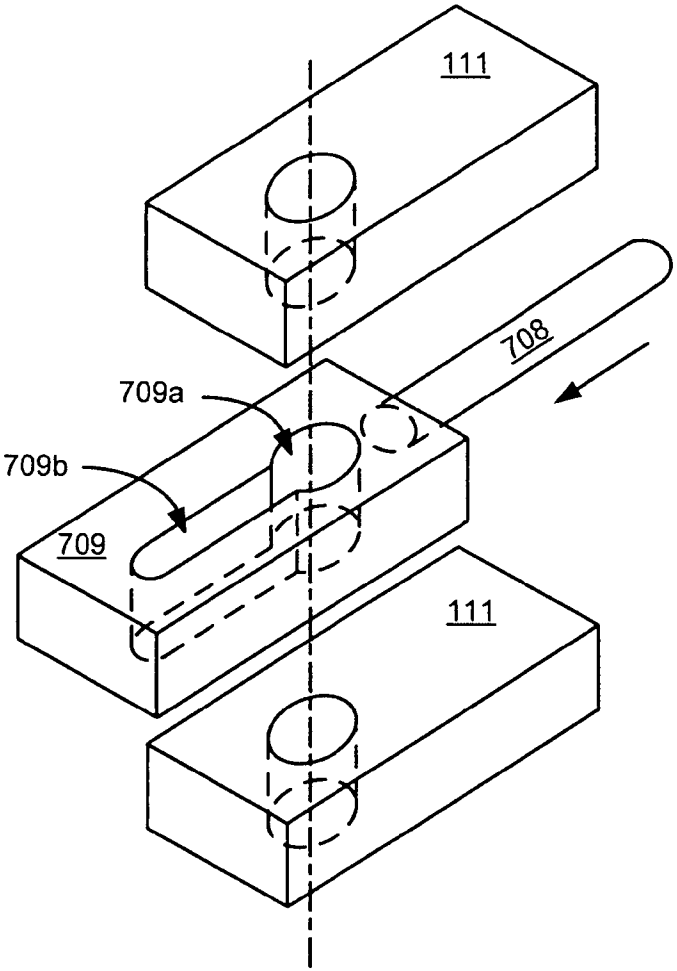

FIGS. 7A and 7B illustrate the operation of the attachment key 709 and the attachment braces 111 in the safety latch mechanism 13 in accordance with an embodiment of the present invention.

FIG. 7A shows the safety latch mechanism 13 in an unlocked or disengaged state, wherein the metal rod 708 has pushed out the attachment key 709 (see also FIG. 1) to cause the opening portion 709*a* of the keyway slot to align with the through-holes in the attachment braces 111. To unlock or disengage the safety latch mechanism 13 so that it is in the state shown in FIG. 7A, the counterweight assembly 14 may be slid towards the center of the cantilever beam 11 such that a part of the counterweight assembly 14 can push against the contact block 703 of the activation assembly 110 and cause the attachment key 709 to slide out. Since the opening portion 709*a* is of a same or similar diameter as the through-holes, their alignment defines a tunnel through which a rod-shaped object with a smaller diameter can pass freely. According to embodiments of the present invention, an attachment element to be secured by the safety latch mechanism 13 can have a rod-shaped tip 750 as shown in FIG. 7B. The outer diameter (D) of the attachment tip 750 may be slightly smaller than the diameters of the opening portion 709*a* of the keyway slot and the through-holes in the attachment braces 111. Therefore, in the unlocked or disengaged state as shown in FIG. 7A, the attachment tip 750 can be inserted, from either the top or bottom side, all the way through the tunnel defined by the opening portion 709*a* and the through-holes. The attachment tip 750 also has a narrowed portion with a diameter (d) that is slightly smaller than the width of the slot portion 709*b* of the key slot but substantially smaller than the outer diameter (D).

FIG. 7B shows the safety latch mechanism 13 in a locked or engaged state, wherein the metal rod 708 has retracted the attachment key 709 (see also FIG. 1) such that the opening portion 709*a* of the keyway slot is no longer aligned with the through-holes in the attachment braces 111. To encourage the activation assembly 110 to return the safety latch mechanism 13 to this locked or engaged state as shown in FIG. 7B, one or more springs may be fitted between the spacer 705 and the stop block in the main rail 102 (shown in FIGS. 3 and 6) and/or between the two spacers 705 and 706. The through-holes are now aligned with the slot portion of the keyway slot which is substantially narrower than the opening portion 709*a* and the through-holes. If the attachment tip 750 has been inserted while the safety latch mechanism 13 was in the unlocked state, the narrowed portion of the attachment tip 750 will fit within the slot portion 709*b* of the keyway slot, but the wider portions of the attachment tip 750 will be trapped by the slot portion 709*b*. As a result, the attachment tip 750 will be securely locked by the safety latch mechanism 13 and cannot be removed unless the cantilever beam 13 is in a substantially level position and the safety latch mechanism 13 is returned to its unlocked state. While locked in by the safety latch mechanism 13, the attachment tip 750 may still be able to rotate around its axis.

It is most preferable to attach or remove an attachment element having the attachment tip 750 or the like when the cantilever beam 11 is in a substantially level position. Only then will the weight of the attachment element (and its payload gripped thereon) cause the attachment tip to naturally align vertically with the through-hole(s) and the opening portion of the attachment key. Otherwise, someone will have to support the weight of the attachment element and its payload to manually align the attachment tip, which could be awkward or difficult to do.

Referring again to FIG. 2, the counterweight assembly 14 comprises a counterweight 105 attached to a selector base 107. A set of roller wheels 106, affixed to the counterweight 105 and/or the selector base 107, may allow the counterweight assembly 14 to slide smoothly along the selector rail 101. The selector base 107 may further comprise a selector pin 108 fitted through a selector sleeve 109. The counterweight assembly 14 can be slid to each pre-marked stop location on the selector rail 101, whereupon the selector pin 108 can be inserted into the hole at that stop location to anchor the counterweight assembly 14. The counterweight 105 and the stop locations on the selector rail 101 may be pre-calibrated such that the counterweight assembly 14 anchored at each stop location will be able to counter-balance an object gripped at the safety latch end of the cantilever beam 11. According to preferred embodiments of the present invention, the objects corresponding to these stop locations may be either standard or non-standard railcar components. Alternatively, the objects may be any equipment or parts that are frequently handled in a mechanic shop or on a job site. A reference chart may be provided that correlate each pre-calibrated stop location to a corresponding object. For example, the stop locations may be correlated to a number of standard railcar components such as air brake valves. According to an alternative embodiment, the selector rail 101 may have a plurality of evenly spaced, numbered holes to accommodate the selector pin 108, and the reference chart may list a number (of the selector hole) for each corresponding equipment or part to be balanced.

Table 1 shows an exemplary reference chart that correlates standard air brake valve components with seven stop locations (holes indicating counterweight positions) on the selector rail 101 shown in FIG. 4. The "Valve Type" column indicates the type of air brake valves to be handled by the tool 100. The "In Car" and "Under Car" columns indicate the color codes for the corresponding valves depending-on whether they are located inside or underneath the railcar. The "Counterweight Position" column lists the hole numbers at the various pre-marked stop locations.

TABLE 1

| Valve Type | In Car | Under Car | Counterweight Position |
|---|---|---|---|
| ABD Service | Blue | Black | Hole 6 |
| ABD Emergency | Yellow | Red | Hole 3 |
| ABDX Emergency | Yellow | Red | Hole 4 |
| ABDW Emergency | Yellow | Red | Hole 5 |
| DB10 Service (cast) | White | White | Hole 7 |
| DB20 Emergency (cast) | Yellow | Red | Hole 5 |
| DB10 Service (aluminum) | White | White | Hole 2 |
| DB20 Emergency (aluminum) | Yellow | Red | Hole 1 |

In fact, with a predefined configuration of the cantilever beam 11 and the counterweight 105, an object of any weight within a certain range could be counter-balanced by the counterweight assembly 14. Other than using the selector pin 108 to anchor the counterweight assembly 14 to pre-drilled holes on the selector rail 101, an alternative anchoring mechanism may allow the counterweight assembly 14 to stop and remain at any point along the selector rail 101. That is, the counterweight assembly 14 may be continuously adjustable according to the load on the safety latch end of the cantilever 11.

With the counterweight assembly 14, a railcar component can be attached to the safety latch end of the cantilever beam 11 and thereby become effectively "weightless" during maintenance work. In order to attach railcar components to the safety latch mechanism 13, there may be provided a number of interchangeable attachment elements each having a tip shaped like the attachment tip 750 shown in FIG. 7B. Each attachment element or a combination of attachment elements may be adapted to securely grip a corresponding railcar component.

Figure 8:
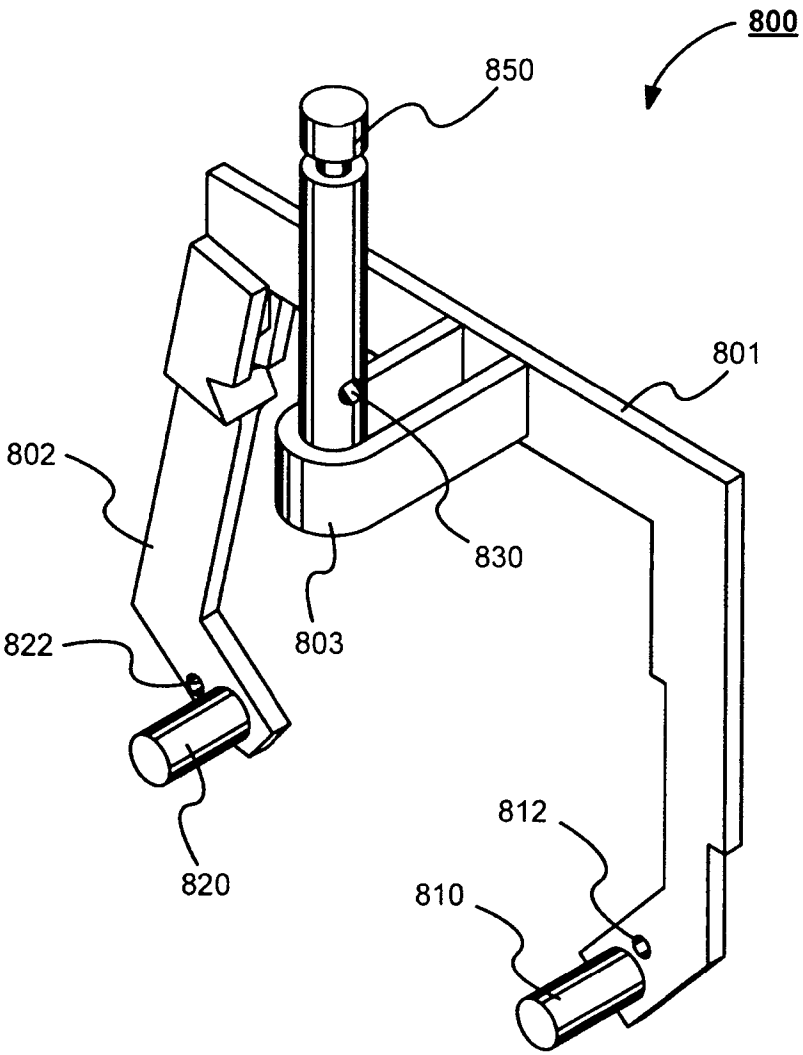
FIGS. 8-9 show various exemplary attachment elements in accordance with embodiments of the present invention.

FIGS. 8-9 show various exemplary attachment elements in accordance with embodiments of the present invention.

FIG. 8 shows an exemplary attachment element or adapter 800. Designed to grip a railcar component (e.g., one or more types of air brake valves), the adapter 800, generally comprises three parts: a fixed arm 801, an adjustable arm 802, and a base 803. The base 803 may further include an attachment tip 850 in a same or similar shape as the attachment tip 750 shown in FIG. 7B which can be inserted into and locked by a safety latch mechanism as described above. The base 803 may also accommodate one or more other attachment elements which can be slid onto the base 803 and anchored by a metal pin inserted into a pin-hole 830. The fixed arm 801 may comprise a protruded tip 810 that matches and fits into a known cavity (e.g., a screw hole) or recessed area on a corresponding railcar component. Similarly, the adjustable arm 802 (which is coupled to the fixed arm 801 and may be able to extend/retract and/or swing/tilt to some extent) may comprise a protruded tip 820 that matches and fits into another known cavity or recessed area on the corresponding railcar component. According to one embodiment of the present invention, the protruded tips 810 and 820 can simultaneously fit into two major mounting holes on most standard air brake valves. Therefore, when attaching the adapter 800 to the corresponding railcar component, the protruded tips 810 and 820 can provide two secure gripping or supporting points by taking advantage of known or existing physical features of the railcar component. Either or both of the protruded tips 810 and 820 may also accommodate other attachment element(s). Pin-holes 812 and 822 may be provided on the fixed arm 801 and the adjustable arm 802 respectively, preferably, near the protruded tips 810 and 820, to receive anchor pins.

Figures 9A, 9B:
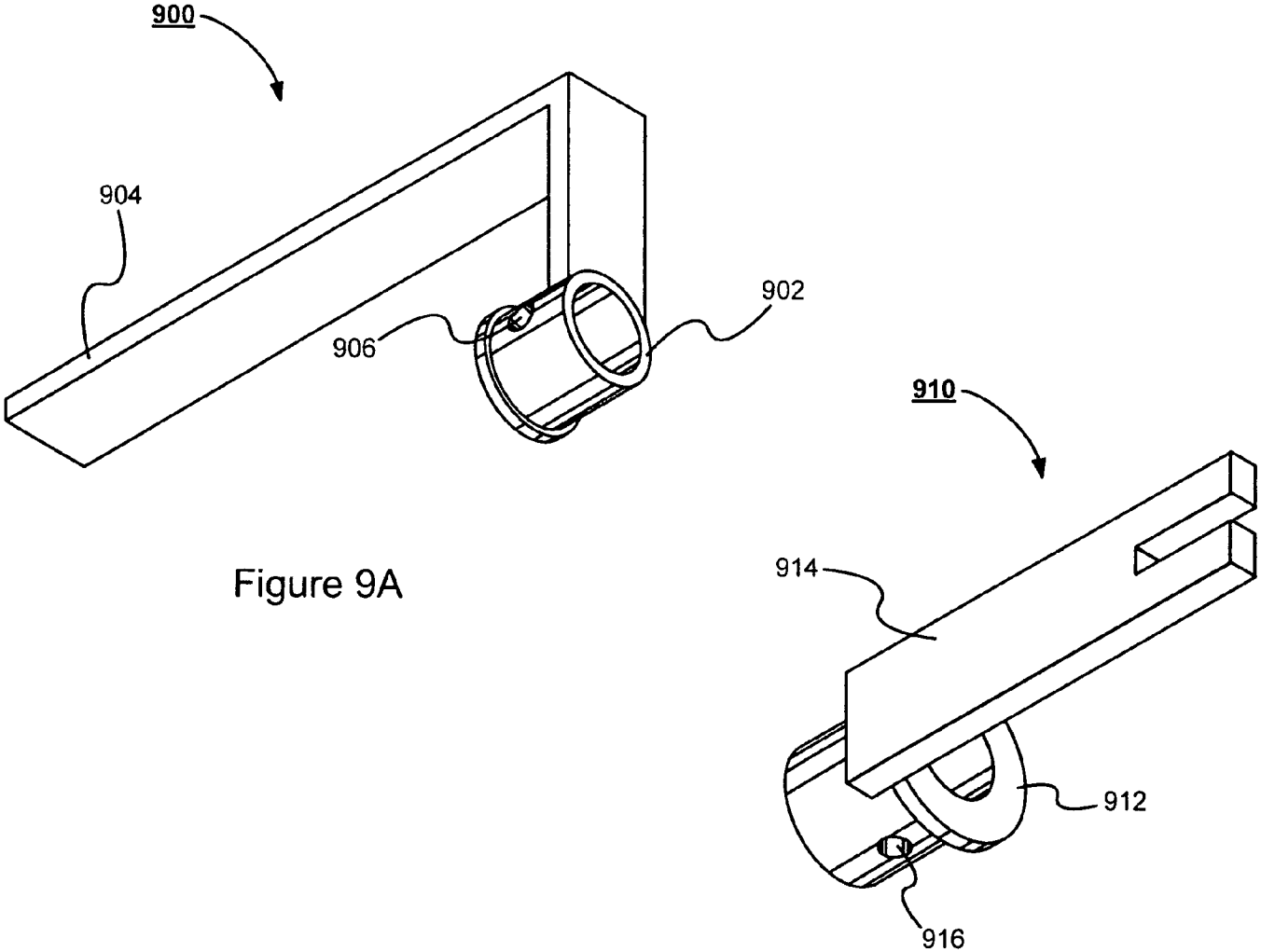

Additional attachment elements or adapters may be combined with the adapter 800 to provide further support or apply gripping force to the railcar component. FIG. 9A shows an exemplary attachment element 900 that can be combined with the adapter 800. The attachment element 900 generally comprises two parts: a huck collar 902 and a support member 904. The huck collar 902 may be just thick enough to allow the base 803 of the adapter 800 to thread through. A pin-hole 906 in the huck collar 902 may be aligned with the pin-hole 830 on the base 803, and they together may receive an anchor pin (not shown) to secure the attachment element 900 to the adapter 800. When the attachment element 900 is combined with the adapter 800, the support member 904 may be pointing either upward or downward, as needed, to provide support for a railcar component gripped by the attachment elements (800 and 900).

FIG. 9B shows another attachment element 910 that can be combined with the adapter 800. The attachment element 910 may comprise a huck collar 912 and a support member 914. The huck collar 912 may fit over the base 803 or at least one of the protruded tips. 810 and 820 on the adapter 800. A pin-hole 916 in the huck collar 912 may receive an anchor pin (not shown) to help secure the attachment element 910 to the adapter 800 or other attachment element(s).

It should be noted that the adapter 800 (and/or other attachment elements) may be attached to the safety latch mechanism on either the top side or the bottom side of the cantilever beam 11. When inserted into the latch from the top side, the adapter 800 will support a railcar component to allow it to stand above the cantilever beam 11. When inserted into the latch from the bottom side, the adapter 800 can hang the railcar component below the cantilever beam 11.

Figure 10:
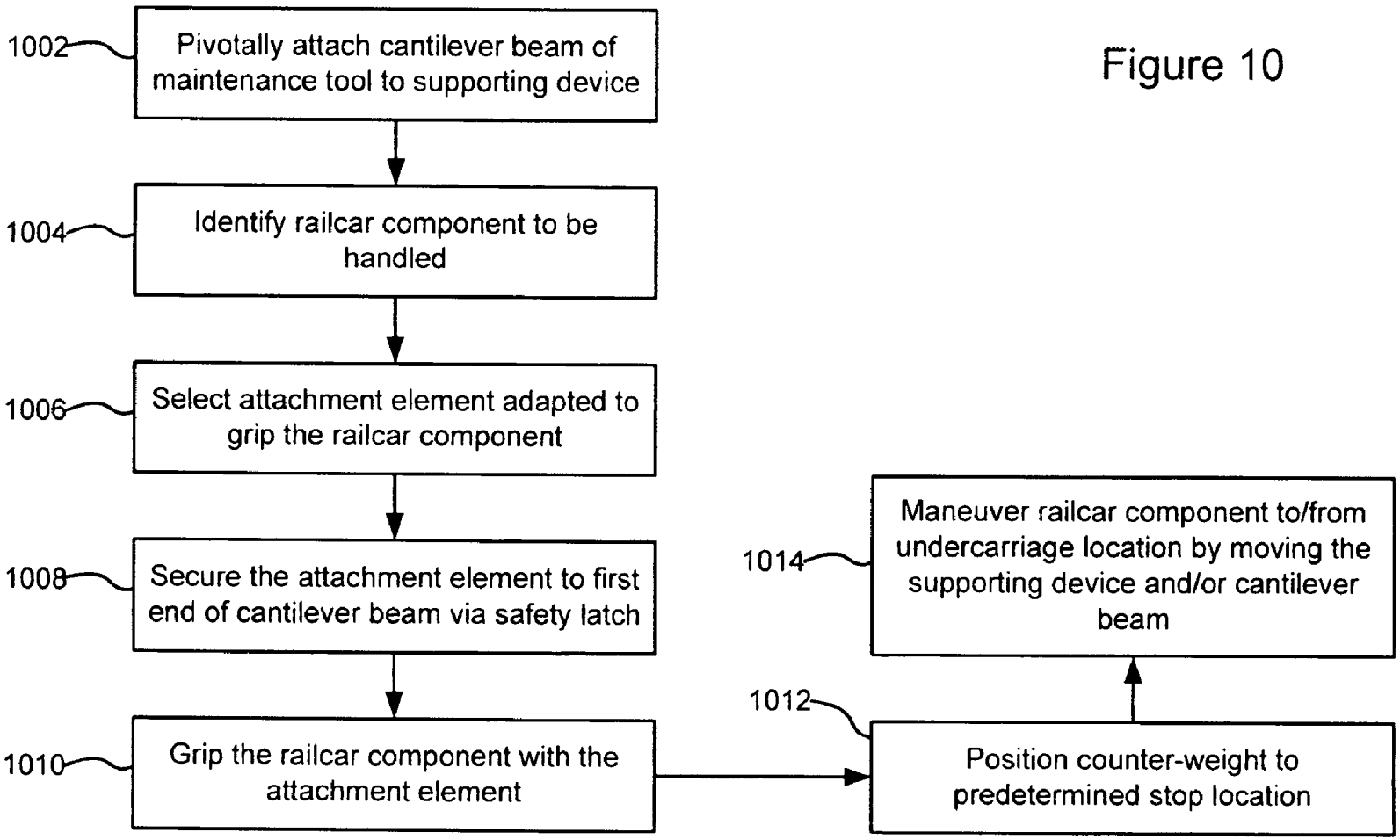
FIG. 10 shows a flow chart illustrating an exemplary method of performing undercarriage maintenance to a railcar in accordance with an embodiment of the present invention.

FIG. 10 shows a flow chart illustrating an exemplary method of performing undercarriage maintenance to a railcar in accordance with an embodiment of the present invention. The method steps may be performed substantially with a maintenance tool (including its attachment element(s)) such as the one described above.

In step 1002, the cantilever beam of the maintenance tool is pivotally attached to a supporting device. As mentioned above, the supporting device may be any of a variety of lifting, hoisting or jacking equipment, including but not limited to a crane, a monorail lifting system, a lift truck, a boom truck, a jack or hoist. The supporting device preferably provides some mobility for the maintenance tool such that it (and its payload) can be moved around freely in a mechanic shop or near a railcar. A pivotal point for the cantilever beam may be provided by a lift hook or ring or a hinge, which preferably allows the cantilever beam to swing in the horizontal directions and/or tilt in the vertical directions.

In step 1004, a railcar component to be handled with the maintenance tool is identified. While the use of this tool is most beneficial for undercarriage maintenance, the railcar component does not have to be one of those undercarriage components. Any railcar equipment or part to be lifted or positioned could be handled by the maintenance tool. In most instances, the railcar component is a standard component whose physical features including weight and dimensions are already known. The component can typically be identified by its model number or part number.

Then, in step 1006, an attachment element adapted to grip the identified railcar component is selected. The selection of the appropriate attachment element may be facilitated by a quick reference chart that matches component part numbers with corresponding attachment elements. For most standard railcar components or those frequently encountered during maintenance work, a specific attachment element or a combination of attachment elements may have already been developed for use with the maintenance tool. So, once an attachment element is selected, it is just a matter of retrieving it from a tool box.

In step 1008, the attachment element(s) selected in step 1006 can be used to grip the railcar component. Taking advantage of the physical features of the railcar component, such as mounting holes or other cavities on the component surface, the selected attachment element(s) may be assembled together (as needed) and attached to the surface of the railcar component. The attachment element(s) may securely grab onto the railcar component and essentially become part of the railcar component. The assembly of the attachment elements (among themselves or onto the railcar component) may benefit from the use of one or more anchor pins or the like.

In step 1010, the attachment element is secured to a first end of the cantilever beam via a safety latch mechanism. When the cantilever beam is a in a level position and the safety latch mechanism is unlocked, the attachment element may be inserted into the safety latch and become locked therein. It should be appreciated that step 1010 may occur either before or after step 1008. As a result of steps 1008 and 1010, the railcar component is safely attached to and supported by the maintenance tool.

Next, in step 1012, a counterweight is positioned to a predetermined stop location towards a second end of the cantilever beam to counter-balance the railcar component. With a reference card as described above, a stop location that corresponds to the railcar component may be quickly determined. Alternatively, the counterweight may be slid to different stop locations until it most closely balances the railcar component at one of those locations. The counterweight may then be anchored at that stop location. By now, the entire maintenance tool or the cantilever beam will be in a substantial balanced and/or level state.

In step 1014, an operator or maintenance mechanic can maneuver the railcar component to or from its undercarriage location or other locations by moving the supporting device and/or the cantilever beam. Since the maintenance tool has rendered the railcar component essentially weightless, the maneuvering or positioning of the railcar component should require little effort from the operator. Nor does the operator have to assume an awkward position during the process as the cantilever beam can swing, tilt and easily extend or reach into tight locations while holding the railcar component steady.

At this point, it should be noted that, although the tool, system, and method in accordance with the present invention have been described here primarily in the context of railcar maintenance, the practical application of the present invention is not necessarily limited to the handling of railcar components. Those skilled in the mechanical art can appreciate that embodiments of the present invention can be adapted to handle almost any kind of mechanical components and physical objects.

While the foregoing description includes many details and specificities, it is to be understood that these have been included for purposes of explanation only, and are not to be interpreted as limitations of the present invention. It will be apparent to those skilled in the art that other modifications to the embodiments described above can be made without departing from the spirit and scope of the invention. Accordingly, such modifications are considered within the scope of the invention as intended to be encompassed by the following claims and their legal equivalents.

The invention claimed is:

1. A tool, comprising:

a cantilever beam having a first end and a second end;

a support element disposed between said first end and said second end for pivotally attaching said cantilever beam to a supporting device;

a first attachment element configured to grip a first railcar component;

a safety latch mechanism, at said first end, for securing said first attachment element, including when said first railcar component is gripped by said first attachment element, and for preventing disengagement of said first attachment element unless said cantilever beam is in a substantially level position, wherein said safety latch mechanism further comprises an elongated member having a contact member; and a weight element adjustably disposed between said support element and said second end, wherein said weight element, when positioned at a first predetermined stop location marked along said cantilever beam, substantially counterbalances said first railcar component gripped by said first attachment element at said first end.

2. A tool, comprising:

a cantilever beam having a first end and a second end;

a support element disposed between said first end and said second end for pivotally attaching said cantilever beam to a supporting device;

a first attachment element configured to grip a first railcar component;

a safety latch mechanism, at said first end, for securing said first attachment element, including when said first railcar component is gripped by said first attachment element, and for preventing disengagement of said first attachment element unless said cantilever beam is in a substantially level position; wherein said safety latch mechanism comprises:

at least one first beam member attached to said cantilever beam and having at least one cavity aligned vertically to allow one end of said first attachment element to pass through when said cantilever is in a substantially level position; and a second beam member disposed adjacent to said at least one first beam member and having a keyway slot, said keyway slot preventing said one end of said first attachment element to pass through unless an opening portion of said keyway slot is substantially aligned with said at least one cavity; and a weight element adjustably disposed between said support element and said second end, wherein said weight element, when positioned at a first predetermined stop location marked along said cantilever beam, substantially counterbalances said first railcar component gripped by said first attachment element at said first end.

3. The tool according to claim 2, wherein:

said second beam member is spring loaded to toggle between an engaged position and a disengaged position;

said opening portion of said keyway slot is not aligned with said at least one cavity when said second beam member is in said engaged position; and said opening portion of said keyway slot is substantially aligned with said at least one cavity when said second beam member is in said disengaged position.

4. The tool according to claim 3, further comprising:

an activation assembly, coupled to said safety latch mechanism, for switching said second beam member between said engaged position and said disengaged position.

5. The tool according to claim 4, wherein said activation assembly further comprises a contact block and is actuated for switching only by said weight element via said contact block.

6. The tool according to claim 1, further comprising:

a second attachment element configured to grip a second railcar component, wherein said first and second attachment elements can be interchangeably secured by said safety latch mechanism.

7. The tool according to claim 6, wherein said weight element, when positioned at a second predetermined stop location marked along said cantilever beam, substantially counterbalances said second railcar component gripped by said second attachment element at said first end.

8. The tool according to claim 6, wherein at least one of said first attachment element and said second attachment element is configured to grip a standard railway part having a predetermined weight and predetermined dimensions.

9. The tool according to claim 1, wherein said first attachment element is configured to grip a standard railcar part having a predetermined weight and predetermined dimensions.

10. The tool according to claim 9, wherein said first railcar component is a standard air brake valve for railcars.

11. The tool according to claim 1, wherein:

said cantilever beam comprises a selector rail along which said weight element can slide; and said selector rail comprises a plurality of pre-marked stop locations such that said weight element, when positioned at each of said plurality of pre-marked stop locations, counterbalances a standard railcar component attached to said first end of said cantilever beam.

12. A system for assisting undercarriage maintenance to a railcar, the system comprising:

a supporting device with at least limited mobility;

a cantilever beam pivotally attached to and supported by said supporting device, said cantilever beam having a first end and a second end;

a plurality of attachment elements, each attachment element being configured to grip a different railcar component;

a safety latch mechanism, at said first end of said cantilever beam, for interchangeably securing any of said plurality of attachment elements and for preventing disengagement thereof unless said cantilever beam is in a substantially level position; and a weight element adjustably disposed toward said second end of said cantilever beam, wherein said weight element, when positioned at each of a plurality of predetermined stop locations marked along said cantilever, substantially counterbalances a corresponding railcar component attached to said first end of said cantilever.

13. A method of performing undercarriage maintenance to a railcar, the method comprising the steps of:

pivotally attaching a cantilever beam to a supporting device;

identifying a railcar component to be handled;

selecting an attachment element adapted to grip said railcar component;

securing said attachment element to a first end of said cantilever beam via a safety latch mechanism that prevents disengagement of said attachment element unless said cantilever beam is in a substantially level position;

causing said railcar component to be gripped by said attachment element before or after said attachment element is secured to said first end of said cantilever beam;

positioning a weight element at a predetermined stop location marked along said cantilever beam such that said weight element substantially counterbalances said railcar component; and moving said railcar component to or from an undercarriage position through movement(s) of said supporting device and/or said cantilever beam.

* * * * *